US007364039B2

(12) United States Patent
Katsuyama

(10) Patent No.: US 7,364,039 B2
(45) Date of Patent: Apr. 29, 2008

(54) INK CARTRIDGE PACKAGING MEMBER, INK CARTRIDGE PACKAGE, AND INK CARTRIDGE PACKAGING AND OPENING METHOD

(75) Inventor: Goro Katsuyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 352 days.

(21) Appl. No.: 10/523,586

(22) PCT Filed: Sep. 8, 2003

(86) PCT No.: PCT/JP03/11448

§ 371 (c)(1),
(2), (4) Date: Feb. 4, 2005

(87) PCT Pub. No.: WO2004/026729

PCT Pub. Date: Apr. 1, 2004

(65) Prior Publication Data

US 2005/0211594 A1 Sep. 29, 2005

(30) Foreign Application Priority Data

Sep. 19, 2002 (JP) ..... 2002-273518

(51) Int. Cl.
*B65D 85/00* (2006.01)

(52) U.S. Cl. ..... 206/320; 206/461; 206/723; 206/724; 206/806

(58) Field of Classification Search ..... 206/460, 206/461, 806, 813, 320, 723, 724; 40/674, 40/673, 657, 638; 346/86–87
See application file for complete search history.

(56) References Cited

U.S. PATENT DOCUMENTS 4,832,301 A * 5/1989 Hiramoto et al. ..... 248/691
4,968,540 A * 11/1990 Linsenbigler ..... 428/5
5,279,410 A * 1/1994 Arashima et al. ..... 206/723
5,728,440 A * 3/1998 Good ..... 428/40.1
5,831,652 A * 11/1998 Hinami et al. ..... 347/86
5,944,355 A * 8/1999 Rich et al. ..... 283/81
6,286,946 B1 * 9/2001 Umemura et al. ..... 347/86
6,942,325 B2 * 9/2005 Nanjo ..... 347/86
2001/0032799 A1 * 10/2001 Shinada ..... 206/724

FOREIGN PATENT DOCUMENTS

CN 2656330 Y 11/2004
JP 2514619 7/1996
JP 2947349 9/1999

(Continued)

OTHER PUBLICATIONS

U.S. Appl. No. 10/523,586, filed Feb. 4, 2005, Katsuyama.

(Continued)

*Primary Examiner*—Bryon P Gehman
(74) *Attorney, Agent, or Firm*—Oblon, Spivak, McClelland, Maier & Neustadt, P.C.

(57) ABSTRACT

In a packing member that packs an ink cartridge, the packing member is constituted as an adhesive label, a perforation is provided on a portion of the label, an ink cartridge is packed by adhering the label on the cartridge, and the ink cartridge is unpacked by peeling off a central portion of the label along the perforation. A back sheet (release coated paper) of the label is adhered on the ink cartridge in a state in which a portion of the back sheet is left. Thus, unpacking (peeling-off of the label) is facilitated, and adhesive is prevented from remaining.

27 Claims, 9 Drawing Sheets

FOREIGN PATENT DOCUMENTS

| | | |
|---|---|---|
| JP | 11-314662 | 11/1999 |
| JP | 2000-255625 | 9/2000 |
| JP | 2001-199473 | 7/2001 |

OTHER PUBLICATIONS

U.S Appl. No. 11/113,174, filed Apr. 25, 2005, Katsuyama et al.

* cited by examiner

INK CARTRIDGE PACKAGING MEMBER, INK CARTRIDGE PACKAGE, AND INK CARTRIDGE PACKAGING AND OPENING METHOD

TECHNICAL FIELD

The present invention relates to a packing member for an ink cartridge, a packed body of an ink cartridge, and a packing/unpacking method of an ink cartridge, and in particular to a packing member for an ink cartridge that packs an ink cartridge used in an inkjet printer, a packed body of an ink cartridge, and a packing/unpacking method of an ink cartridge.

BACKGROUND ART

There is conventionally known an inkjet printer that jets fine ink droplets from nozzles toward a recording medium such as a sheet to conduct recording. A replacement ink cartridge used in the inkjet printer is usually packed with a packing member such as a bag or a case, and it is displayed in shops such as an electronic store or a computer supply store.

For example, Japanese Patent Application Laid-Open No. 2001-199473 discloses a packing case formed of a paper box for accommodating an ink cartridge.

Further, Japanese Patent Application Laid-Open No. 2000-255625 discloses a film-like packing member for packing an ink cartridge.

However, in conventional ink cartridge packing members including ones described in Japanese Patent Application Laid-Open No. 2001-199473 and Japanese Patent Application Laid-Open No. 2000-255625, there is a problem that packing or unpacking is troublesome.

For example, in the packing case described in the above Patent Literature 1, ten or more folding portions including margins for pasting (adhesion portion) must be folded along folding lines and the margins for pasting are adhered to predetermined portions, which packing work is troublesome. Further, in the packing member described in Japanese Patent Application Laid-Open No. 2000-255625, a cartridge must be rotated 1 and ¾ times until packing is completed, that is, the cartridge must be wound by the film-like packing member about two times and thermal adhesion must then be conducted around the cartridge, which packing work is troublesome.

As described in Japanese Patent Application Laid-Open No. 2001-199473, in a system where an ink cartridge is accommodated in a packing case constituted of a paper bag, generally, after the ink cartridge is accommodated in a bag constituted of a film material or the like, it is accommodated in a paper box case, which requires a work for opening the paper box to further open the bag, and requires a troublesome unpacking work. Further, the packing member described in Japanese Patent Application Laid-Open No. 2000-255625 also requires uncoiling of the packing member about two times for unpacking, which unpacking work is troublesome.

The conventional ink cartridge packing member has such a problem that a large amount of rubbish is disposed after unpacking. In particular, when an ink cartridge is accommodated in a paper box case after it is received in a bag formed of film material, both the bag and the paper box opened become rubbish, which increases the amount waste. Further, the packing member described in Japanese Patent Application Laid-Open No. 2000-255625 requires a packing material with a large area sufficient for about two windings around the cartridge, and all of the unpacked packing materials become rubbish.

It is an object of the present invention to solve the above problems in the conventional packing of an ink cartridge, and to provide a packing member for an ink cartridge that makes packing and unpacking easy and can reduce an amount of rubbish disposed after unpacking, a packed body of an ink cartridge, and a packing/unpacking method of an ink cartridge.

DISCLOSURE OF THE INVENTION

In a packing member for an ink cartridge according to the present invention, the packing member is constituted as an adhesive label, a portion of the label is applied with a cutting-off assisting work, the ink cartridge is packed by adhering the label on the ink cartridge, and the ink cartridge is unpacked by peeling off one portion of the label along the cutting-off assisting work.

According to the present invention, since the packing member is constituted as the adhesive label, the cutting-off assisting work is provided on one portion of the label, the ink cartridge is packed by adhering the label to the cartridge, and the ink cartridge is unpacked by peeling off the one portion of the label along the cutting-off assisting work, the amount of the packing member can be reduced and the amount of rubbish to be disposed due to unpacking can be reduced. Further, packing and unpacking can be performed easily.

In a packing member for an ink cartridge according to the present invention, one portion of release coated paper of the adhesive label is left unpeeled to be adhered on the cartridge.

According to the present invention, since one portion of the release coated paper of the adhesive label is left unpeeled to be adhered on the cartridge, peeling-off of the label at an unpacking time is easy.

In a packing member for an ink cartridge according to the present invention, the release coated paper left unpeeled is formed on a portion of the label that is cut off at an unpacking time.

According to the present invention, since the release coated paper left unpeeled is formed on a portion of the label to be cut off at an unpacking time, a portion of the label unpacked by being cutting off can be peeled off from the cartridge easily, and adhesive can be prevented from remaining on the cartridge surface after unpacking.

In a packing member for an ink cartridge according to the present invention, an end side of at least one portion of the release coated paper left unpeeled is provided with a tearing-off line for the release coated paper along the cutting-off assisting work.

According to the present invention, since the tearing-off line for the release coated paper is provided such that an end side of at least one portion of the release coated paper left unpeeled extends along the cutting-off assisting work, cutting-off of the label can be performed using the end side of the release coated paper as a core, cutting-off is prevented from deviating from the cutting-off assisting work, which facilitates the unpacking work.

In a packing member for an ink cartridge according to the present invention, a portion of the label cut off at the unpacking time has, on a back face of the label, an adhesive exposure portion having a predetermined range within the cutting-off assisting work.

According to the present invention, since a portion of the label to be cut off at an unpacking time has the adhesive exposure portion on the label back face in a predetermined range within the cutting-off assisting work, floating of the cutting-off portion can be suppressed to the utmost even if the release coated paper is left.

In a packing member for an ink cartridge according to the present invention, a hanging portion formed with a hanging rail insertion hole is provided.

According to the present invention, since the hanging portion formed with the hanging rail insertion hole is provided, displaying, storing, or the like can be performed easily.

In a packing member for an ink cartridge according to the present invention, the hanging portion is partially left with the release coated paper of the adhesive label.

According to the present invention, since the release coated paper of the adhesive label is partially left on the hanging portion, the strength of the hanging portion can be increased.

In a packing member for an ink cartridge according to the present invention, two label surface sheets are adhered to each other so as to sandwich the partially left release coated paper to form the hanging portion.

According to the present invention, since the hanging portion is formed by adhering two label surface sheets to each other so as to sandwich the release coated paper left partially, the strength of the hanging portion can be further enhanced.

In a packing member for an ink cartridge according to the present invention, a tearing-off line for the partially left release coated paper serves as an assisting line when the two label surface sheets are adhered to each other.

According to the present invention, since the tearing-off line of the release coated paper left partially serves as an assistant line when two label surface sheets are adhered to each other, an adhering work can be facilitated, and the label surface sheets do not adhere to each other with a state deviated from each other.

In a packing member for an ink cartridge according to the present invention, the two label surface sheets on the hanging portion and the left release coated paper have the same shape.

According to the present invention, since the shapes of the two label surface sheets and the left release coated paper in the hanging portion are the same, the strength of the entire hanging portion can be further enhanced.

In a packing member for an ink cartridge according to the present invention, the hanging portion is an unpacking start portion at an unpacking time of the cartridge.

According to the present invention, since the hanging portion is the unpacking starting portion at a time of cartridge unpacking, an unpacking work can be conducted easily by utilizing the hanging portion as a guide at a time of peeling off the label.

In a packing member for an ink cartridge according to the present invention, a wide exposure portion of adhesive is formed at a proximal portion of the hanging portion.

According to the present invention, since the wide exposure portion of adhesive is formed on the proximal portion of the hanging portion, the proximal portion of the hanging portion that is easily peeled off can be firmly adhered.

In a packing member for an ink cartridge according to the present invention, the cutting-off assisting work starts on an extension line of both side edges of the hanging portion.

According to the present invention, since the cutting-off assisting work starts from extension lines on both side edges of the hanging portion, the unpacking work can be conducted smoothly while holding the hanging portion.

In a packing member for an ink cartridge according to the present invention, cuttings are provided at both sides of the proximal portion of the hanging portion in a predetermined range.

According to the present invention, since cuttings are provided in predetermined ranges on both sides of the proximal portion of the hanging portion, the label can be prevented from being damaged at the proximal portion of the hanging portion and even if the label is peeled off at the proximal portion, the peeled-off label can be recovered to its original state by re-adhering.

In a packing member for an ink cartridge according to the present invention, ends of the cuttings and ends of the cutting-off assisting work are in communication with each other.

According to the present invention, since the ends of the cuttings and the end of the cutting-off assisting work are in communication with each other, cutting is naturally guided by the assisting work in unpacking work conducted while the hanging portion is held, so that the unpacking work is facilitated and the label is prevented from being damaged.

In a packing member for an ink cartridge according to the present invention, a tearing-off line for the release coated paper is provided so as to allow continuous peeling-off of the release coated paper across the cutting-off assisting work.

According to the present invention, since the tearing-off line for the release coated paper is provided such that the release coated paper can be continuously peeled off to cross the cutting-off assisting work, the release coated paper of the cutting-off portion and the remaining portion can be continuously peeled off using the cutting-off assisting work as a boundary, which facilitates the packing work.

In a packing member for an ink cartridge according to the present invention, an ink supplying portion of the ink cartridge is sealed by a portion of a label cut off at the unpacking time.

According to the present invention, since the ink supplying portion of the ink cartridge is sealed with a portion of the label cut off at an unpacking time, it is unnecessary to provide a sealing member separately.

In a packing member for an ink cartridge according to the present invention, a remaining portion of the label left at the unpacking time is adhered on a joining portion of a member constituting an exterior case of the ink cartridge even after unpacking.

According to the present invention, since the remaining portion cut off at an unpacking time is adhered to the joining portion of a member constituting the exterior case of the ink cartridge even after unpacking, the strength of the cartridge can be maintained even after unpacking.

In a packing member for an ink cartridge according to the present invention, a remaining portion of the label left at the unpacking time is adhered on a fitting portion of a part constituted as a separate part into the case main unit near an ink supplying portion of the ink cartridge even after unpacking.

According to the present invention, since the remaining portion cut-off at an unpacking time is adhered to the fitting portion of a part constituted as a separate part to the case main unit near the ink supplying portion of the ink cartridge even after unpacking, the fitting of the separate part into the case main unit can be reinforced even after unpacking.

In a packing member for an ink cartridge according to the present invention, the packing member is constituted as a sheet of adhesive label.

According to the present invention, since the packing member is constituted as one sheet of adhesive label, cost for the packing member can be suppressed.

In a packing member for an ink cartridge according to the present invention, the packing member is formed by punching in one step.

According to the present invention, since the packing member is formed by punching in one step, cost for the packing member can be suppressed.

In a packing member for an ink cartridge according to the present invention, release coated paper tearing-off line of the packing member is formed by die cutting in one step.

According to the present invention, since the tearing-off line for the release coated paper of the packing member is formed by die cutting in one step, cost for the packing member can be suppressed.

In a packing member for an ink cartridge according to the present invention, a portion cut off at the unpacking time is formed in a substantially Y shape.

According to the present invention, since a portion to be cut off at an unpacking time is formed in a substantially Y shape, unpacking is facilitated by reducing a cut-off area, and since the area of the label left after unpacking increases, an amount of information that can be indicated on the label can be increased.

In a packing member for an ink cartridge according to the present invention, information required before cartridge unpacking is indicated on a portion cut off at the unpacking time.

According to the present invention, since the information required before cartridge unpacking is indicated on the portion to be cut off at an unpacking time, an indication required by the user can be seen when it is necessary. Indications after unpacking can be seen more clearly.

In a packing member for an ink cartridge according to the present invention, information required after cartridge unpacking is indicated on a remaining portion left after cut off at the unpacking time.

According to the present invention, since information required after cartridge unpacking is indicated on the remaining portion to be cut off at the unpacking time, an indication required by the user can be seen when it is necessary.

In a packed body of an ink cartridge according to the present invention, an ink cartridge is packed with a packing member described in any one of the above packing members.

According to the ink cartridge packed body of the present invention, the amount of the packing member can be reduced and the amount of rubbish to be disposed after unpacking can be reduced. Packing and unpacking works are conducted easily.

A packing/unpacking method of an ink cartridge according to the present invention is a packing/unpacking method of an ink cartridge that packs an ink cartridge with a packing member or unpacks the ink cartridge, and includes steps of adhering the packing member constituted as an adhesive label partially applied with a cutting-off assisting work on the ink cartridge to pack the ink cartridge, and peeling off a portion of the adhesive label along the cutting-off assisting work to unpack the ink cartridge.

According to the packing/unpacking method of an ink cartridge of the present invention, the amount of the packing member can be reduced and the amount of rubbish to be disposed after unpacking can be reduced. Packing and unpacking works are conducted easily.

BEST MODE FOR CARRYING OUT THE INVENTION

The present invention will be explained in detail with reference to the accompanying drawings.

Figure 1A:
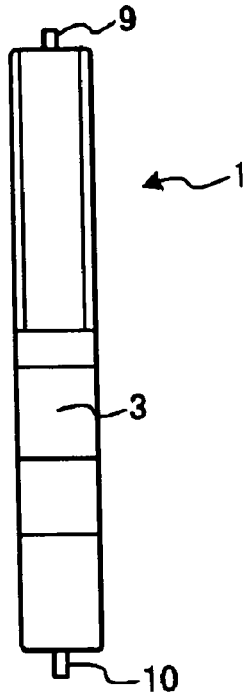
FIGS. 1A, 1B, and 1C are appearance views of one example of an ink cartridge packed with a packing member according to the present invention.
Figure 1B:
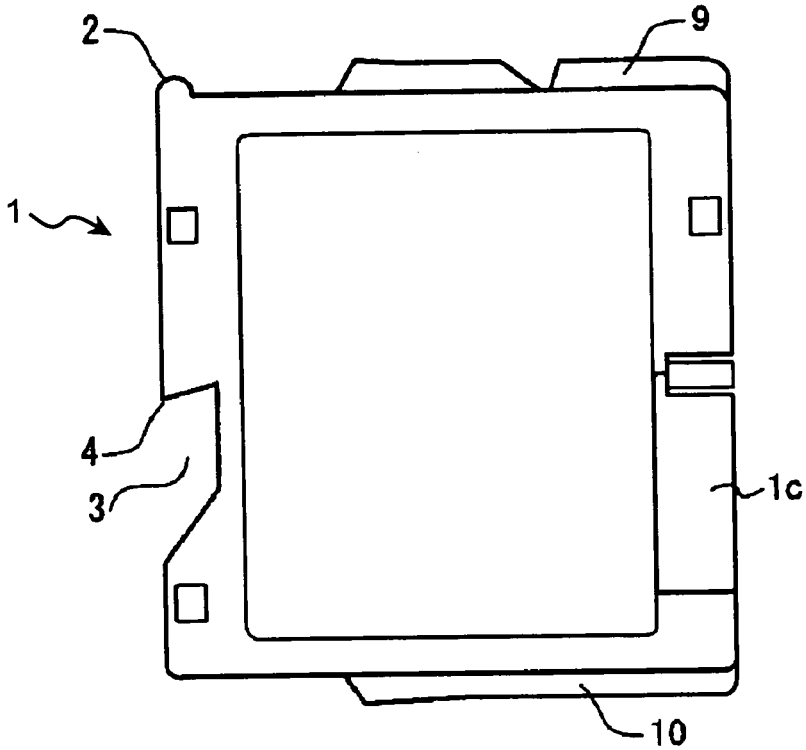
Figure 1C:
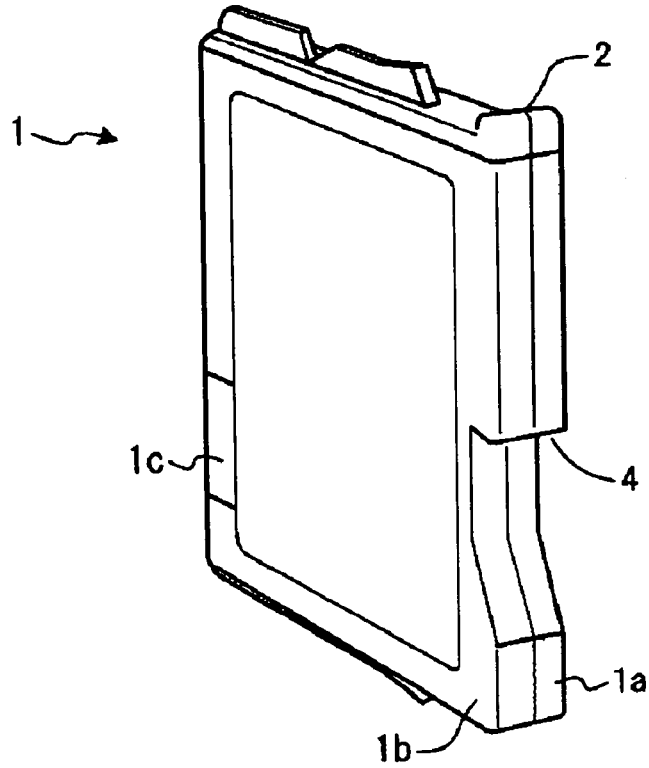

FIGS. 1A, 1B, 1C, and 1D are appearance views of one example of an ink cartridge packed with a packing member according to the present invention, FIG. 1A being a front view, FIG. 1B being a side view, and FIG. 1C being a perspective view. In the following explanation, a face shown in FIG. 1A is a front face of a cartridge, a side (back side) opposed thereto is a rear face of the cartridge, a face shown in FIG. 1B is a right side face of the cartridge, and a side opposed thereto, namely, a side shown in FIG. 1C is a left side face of the cartridge. Further, an upper side on FIG. 1A is defined as an upper face and a lower side hereon is defined as a lower face.

As apparent from FIGS. 1A to 1D, a cartridge 1 is fundamentally formed in a rectangular parallelepiped shape and has a shape approximating to a square when seen from a side face thereof. When the cartridge 1 is seen from its front, it has a considerably large height as compared with its width, and is formed in a thinned type.

A projection portion 2 is formed on a front end portion on an upper face of the cartridge. The projection portion 2 constitutes as a first finger putting portion on which a finger of a user is put when the cartridge 1 is held. Further, a notch portion 3 is formed on a portion of a front face of the cartridge that is positioned slightly below the center thereof in a shape recessed toward the inside of the cartridge. A corner portion 4 on an upper side of the notch portion 3 constitutes a second finger putting portion on which a finger of the user is put when the cartridge 1 is held. A portion extending from the projection portion 2 to the corner portion 4 constitutes a holding portion applied for holding the cartridge 1.

The ink cartridge 1 has an exterior case constituted of three parts of left and right side face cases 1*a* and 1*b*, and a rear portion cover 1*c* that covers an ink filling portion described later. Guide members 9 and 10 applied when the ink cartridge 1 is mounted on a cartridge mounting portion of a printer main unit (not shown) are formed on an upper face and a bottom face of the cartridge.

Figure 2:
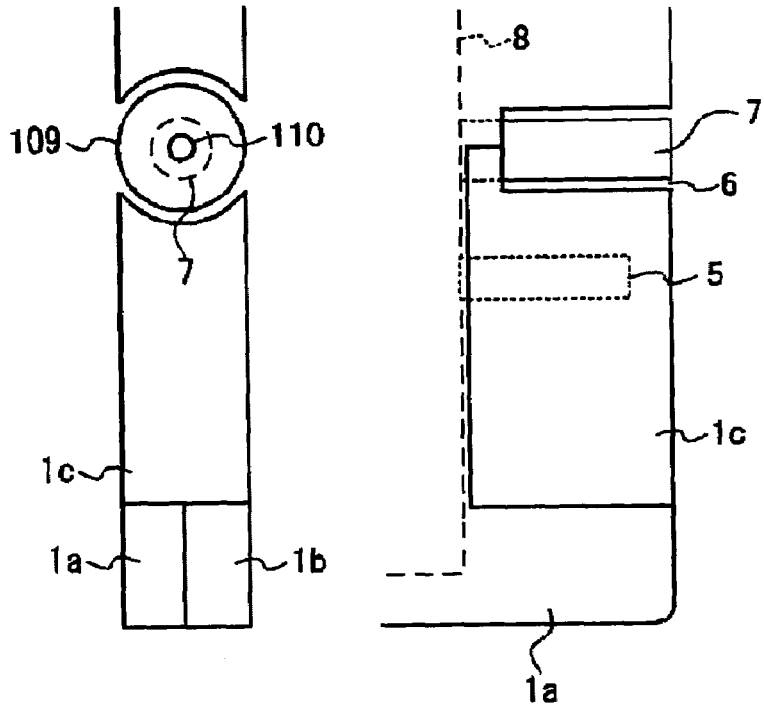
FIG. 2 is partial view of a rear face portion of the ink cartridge.

As shown in FIG. 2, a notch 6 is formed on a rear face portion of the ink cartridge 1. An ink supplying tube 7 connected to an ink bag 8 housed in the cartridge is provided to be positioned inside the notch 6. A rubber is fitted into the ink supplying tube 7, and an ink supplying needle 110 (FIG. 3) provided in the printer main unit projectingly penetrates the ink supplying tube 7 so that a distal end of the needle advances into the ink bag 8, which allows supplying of ink. When the ink supplying needle 110 is drawn out (the cartridge is demounted), the rubber in the ink supplying tube 7 closes a hole formed by the needle, which prevents ink from leaking.

As shown on a rear face view on the left side in FIG. 2, the notch 6 has an almost circular section opened (notched) at both side faces of the cassette. The ink supplying tube 7 with a cylindrical section is provided concentrically with the notch 6.

Figure 3:
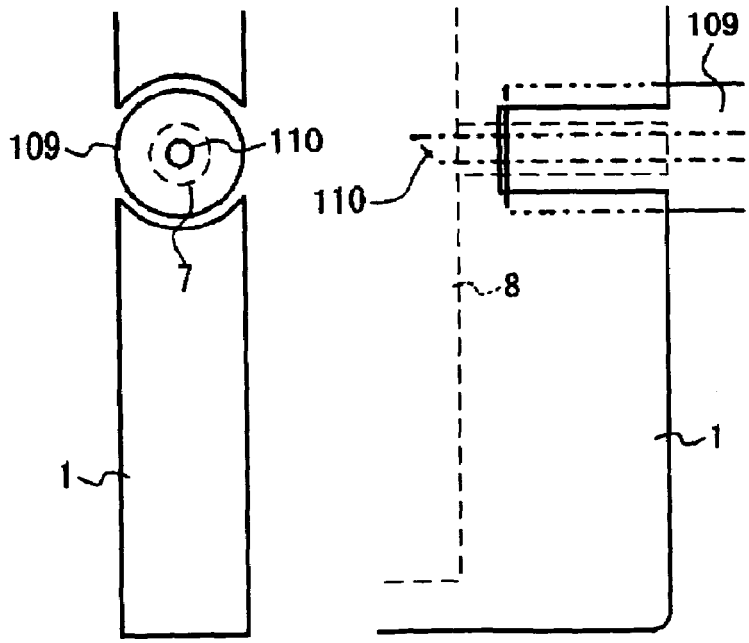
FIG. 3 is a partial view for explaining ink supply from the ink cartridge.

On the other hand, as shown in FIG. 3, the ink supplying needle 110 whose periphery is protected by a protective pipe 109 is provided on the main unit side of the printer, not shown. The ink supplying needles 110 are provided in the number corresponding to the number of colors (the number) of cartridges. The protective pipe 109 is shorter in length than that of the ink supplying needle 110, and the ink supplying needle 110 is disposed in the depth of the cartridge mounting portion of the printer main unit in a state in which the ink supplying needle 110 projects from a distal end of the protective pipe 109. When the ink cartridge 1 is completely mounted on the cartridge mounting portion (not shown), as shown in FIG. 3, the ink supplying needle 110 penetrates the ink supplying tube 7 so that the needle distal end advances into the ink bag 8. Ink in the cartridge (in the ink bag 8) is supplied to a printhead during printing.

In FIG. 2, an ink filling tube 5 is provided to be positioned below the ink supplying tube 7 and be connected to the ink bag 8. The ink filling tube 5 is used for filling ink into the ink bag 8 in a factory. After the ink bag 8 filled with ink is accommodated in the left and right side face cases 1*a* and 1*b*, the ink filling portion is covered and only the ink supplying tube 7 is exposed to the cartridge rear face by fitting the rear portion cover 1*c* to the side face cases 1*a* and 1*b*.

A packing member that packs the ink cartridge 1 constituted as above will be explained below.

Figure 4:
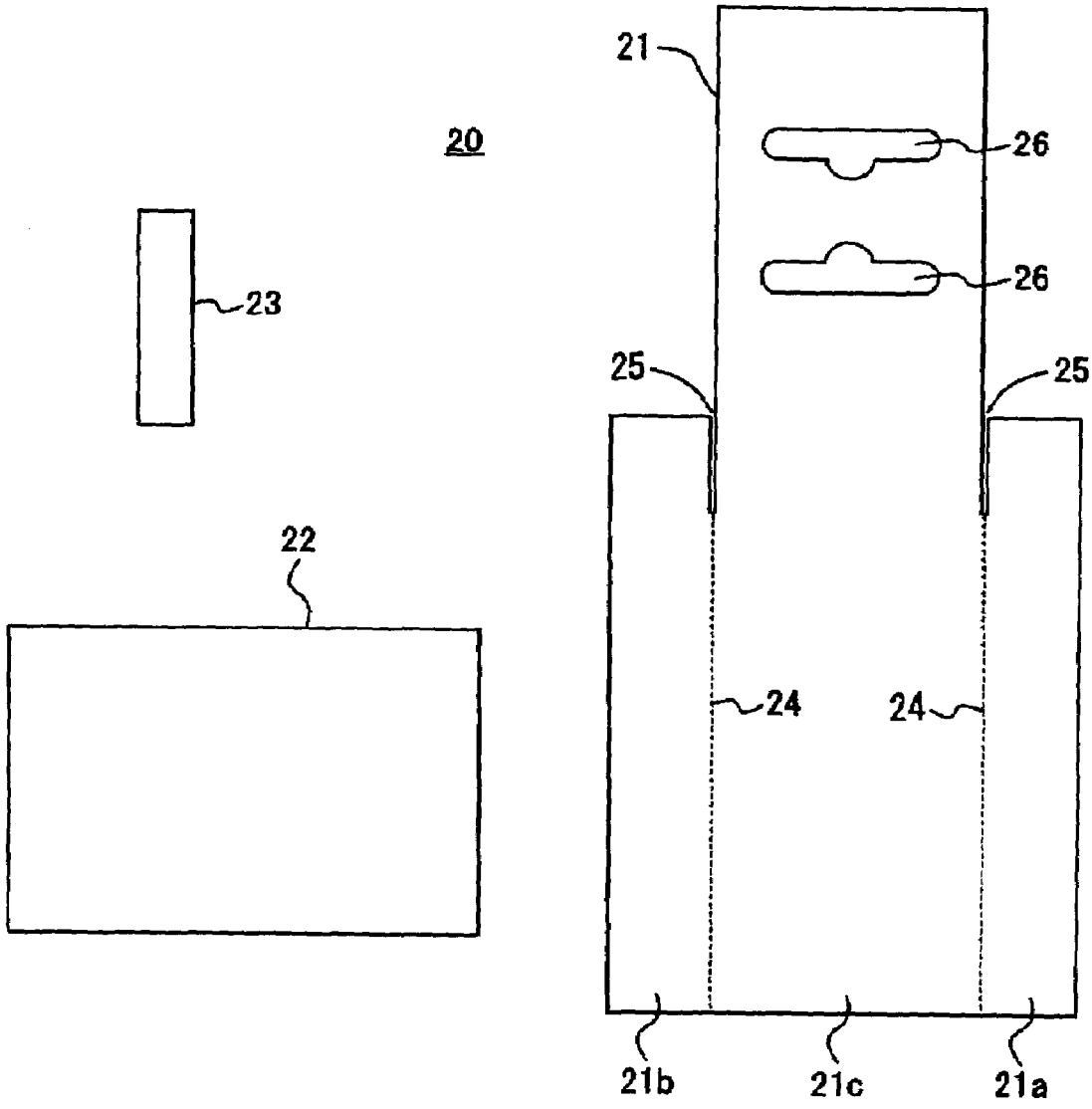
FIG. 4 is a plan view of one embodiment of the packing member according to the present invention.

FIG. 4 is a plan view of one embodiment of the packing member according to the present invention. A cartridge packing member 20 shown in the drawing is constituted of three labels (tack paper) of a main label 21, a side face label 22, and a front face label 23. Here, the packing member is divided into three sheets, but it may be provided on one or two pieces of tack paper as three parts. A surface (outer face) of the packing member 20 is shown in FIG. 4.

The main label 21 is formed in a "convex" shape with a vertically longer side, and the side face label 22 and the front face label 23 are rectangular. Each label is an adhesion sheet constituted of a surface base material (surface sheet)/adhesive/release coated paper (a back sheet). As the surface base material, for example, not only such a label sheet as a cast-coated paper or a woodfree paper, or a cardboard or a coating paper/a recycled paper, but also a film label can be used. As the adhesive, recyclable adhesive is suitable.

Further, the surface of release coated paper is generally laminated with polyethylene and applied with a silicon releasing agent. However, release coated paper of a type having, for example, a clay-coated layer, that does not use a polyethylene film that obstructs recycling or the like is developed, and such a recyclable paper is preferable.

The side face label 22 is adhered to a right side face of the cartridge 1, namely, the right side face case 1*a* shown in FIG. 1B. The front face label 23 is adhered to a portion between the projection portion 2 and the corner portion 4 of the cartridge front face. The main label 21 is adhered to a portion of the cartridge 1 from the left side face up to a portion of the cartridge right side face via the rear face portion in a turning manner (see FIGS. 7A and 7B).

The main label 21 having the "convex" shape with a vertically longer side is constituted of three portions of a right side portion 21*a*, a left side portion 21*b*, and a central portion 21*c*. Perforations 24, 24 are provided at boundaries between the central portion 21*c* and both the side portions 21*a* and *b*. When the cartridge is opened, the central portion 21*c* is released from the both side portions 21*a* and *b* along the perforations 24, 24. The perforations 24, 24 are provided so as to penetrate the surface sheet to the release coated paper (the back sheet), namely the label from its surface to its back surface. Here, such an expression as perforations is used, not only the perforations (discontinuous holes) but any assistant working that facilitates cutting-off can be utilized in the present invention.

In FIG. 4, cuttings 25, 25 are provided at upper portions of perforations 24, 24, namely in predetermined ranges extending from corners defined between the central portion 21*c* and the both left and right side portions 21*a* and *b* toward the perforations 24, 24. The cuttings 25, 25 are for assisting opening of the cartridge such that the central portion 21*c* can be released smoothly along the perforations 24, 24. Functions of the cuttings 25, 25 will be described later together with explanation about of opening work.

Figure 5:
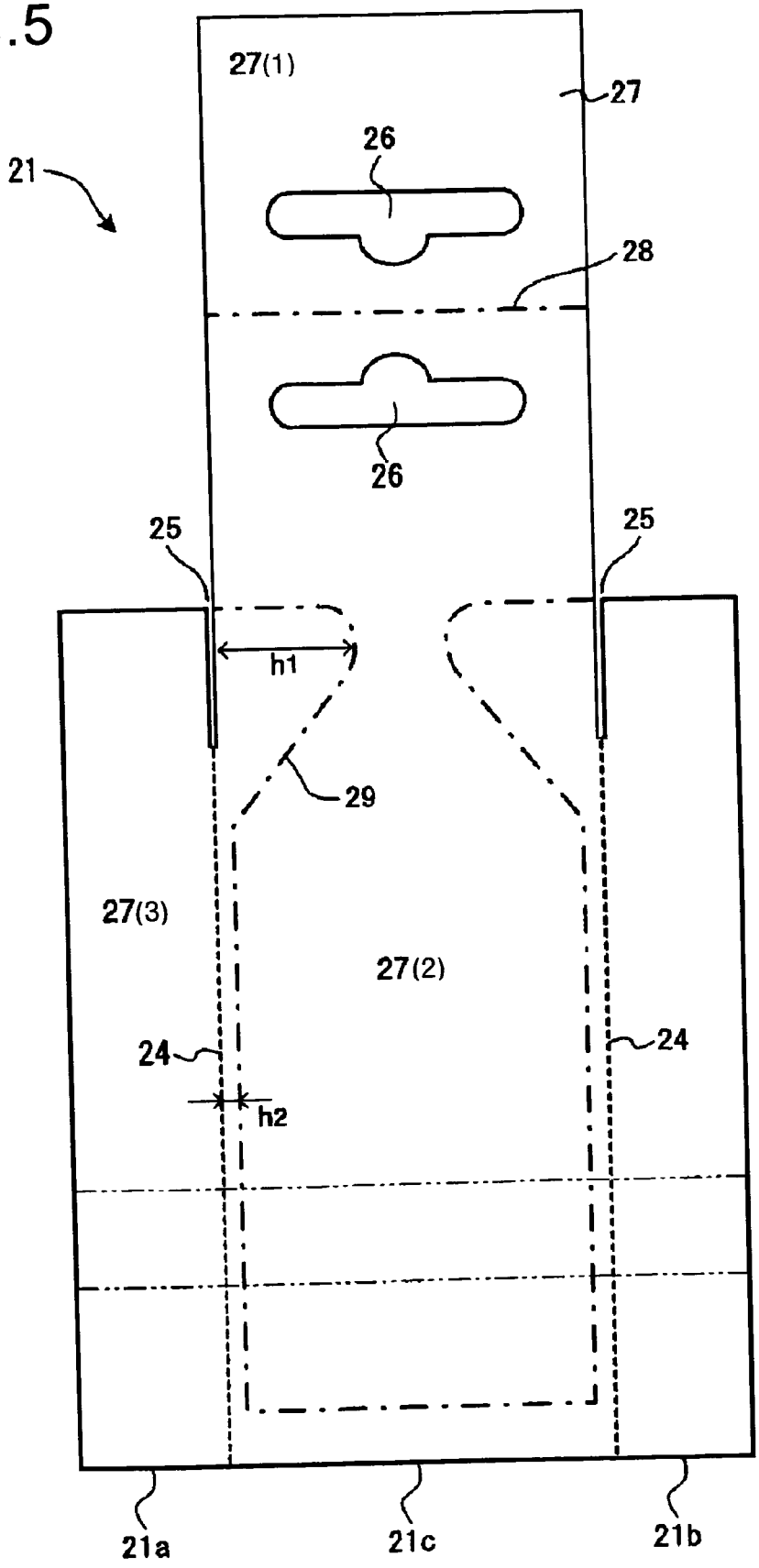
FIG. 5 is a plan view of a back side of a main label of the packing member.

Two notches 26, 26 are provided at an upper portion of the central portion 21*c* shown in FIG. 4. The two notches 26, 26 have the same shape but their orientations are reversed to each other. The two notches 26, 26 are superimposed to each other at a packing time as described later, thereby, serving as holes that allow insertion of a hanging rail in a shop FIG. 5 is a plan view (a rear view) of a back side of the main label 21.

As shown in the drawing, two cutting lines (tearing-off lines) 28 and 29 are provided on the release coated paper (the back sheet) 27 of the main label 21. The release coated paper 27 is partitioned to three portions ((1) to (3)) through the two cutting lines 28 and 29. The cutting line 28 is positioned at the center between the two notches 26, 26 and is provided to be parallel to a bottom side and an upper side (in FIG. 5) of the main label 21. The cutting line 29 is formed symmetrically such that, after lines constituting the cutting line extend from the corner portions defined between the central portion 21*c* and both the side portions 21*a* and *b* inwardly, they turn to extend obliquely downwardly and outwardly, further extend in parallel to the perforations 24, 24, and change their directions at a right angle inwardly at a predetermined distance from the bottom side of the label to connect to each other. When the maximum distance from the cuttings 25, 25 at an upper end portion of the cutting line 29 (that is, a starting portion of the cutting line 29) is represented as h1, and a distance from the perforation 24 at a portion of the cutting line 29 that extends in parallel with the perforations 24, 24 is represented as h2, h1>h2 (h1 is considerably larger than h2) can be obtained.

Figure 6:
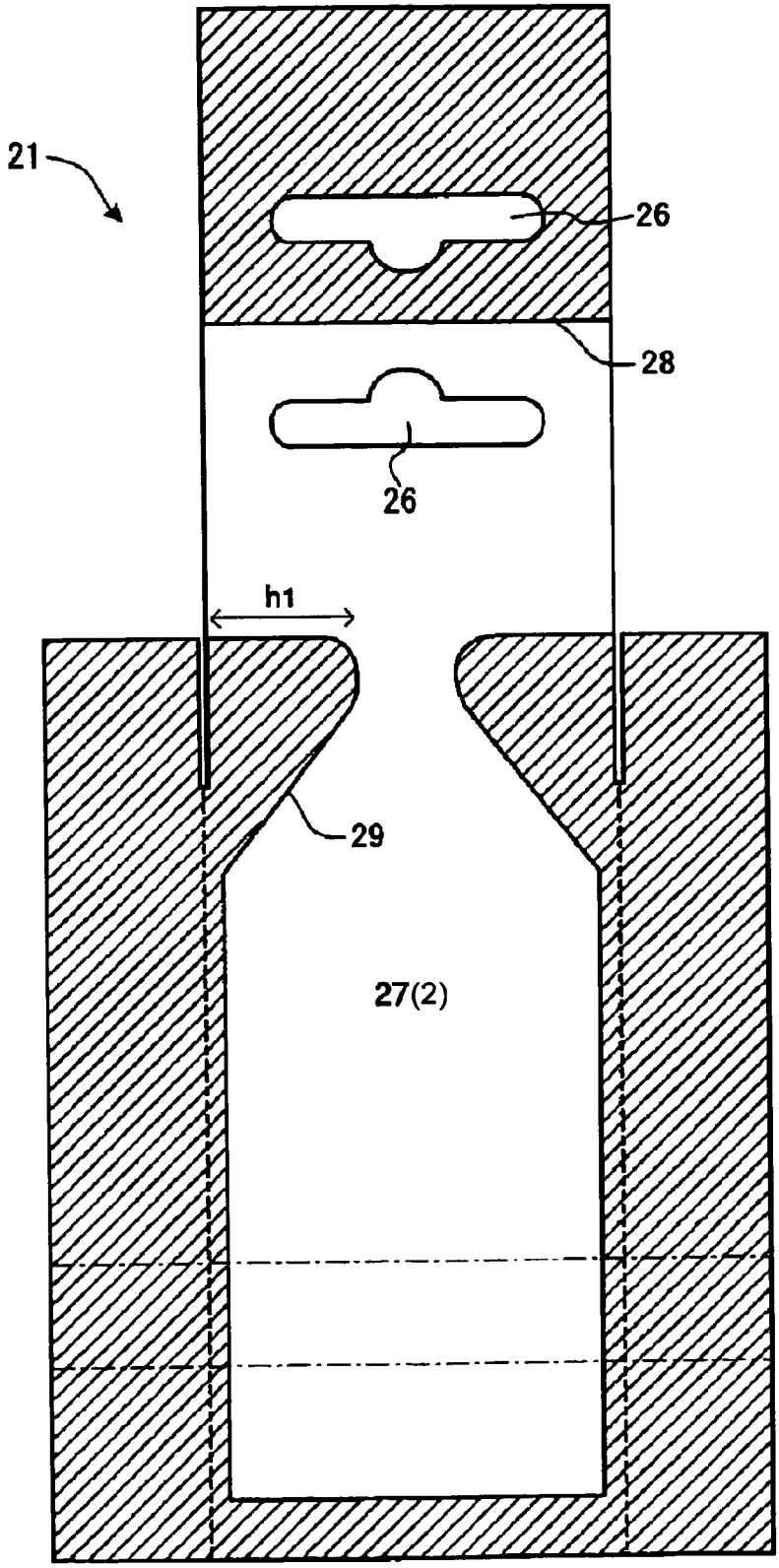
FIG. 6 is a plan view of a state in which a portion of release coated paper for the main label has been peeled off.

When the ink cartridge 1 is packed, the upper portion release coated paper 27(1) and the lower both side portions release coated paper 27(3) of the release coated paper 27 of the main label 21 are peeled off, and the central portion release coated paper 27(2) is left unpeeled. FIG. 6 depicts a state in which the release coated paper 27(1) and the release coated paper 27(3) have been peeled off. In FIG. 6, hatched portions are portions of the main label from which the release coated paper have been peeled off so that adhesives on the back face of the surface sheet are exposed.

On the other hand, the side face label 22 and the front face label 23 are simply rectangular, and release coated paper thereof are also rectangular. Cutting lines may be provided on the release coated paper for facilitating peeling-off, as necessary. Further, the side face label 22 and the front face label 23 may be provided on the same (one) tack paper.

Figure 7A:
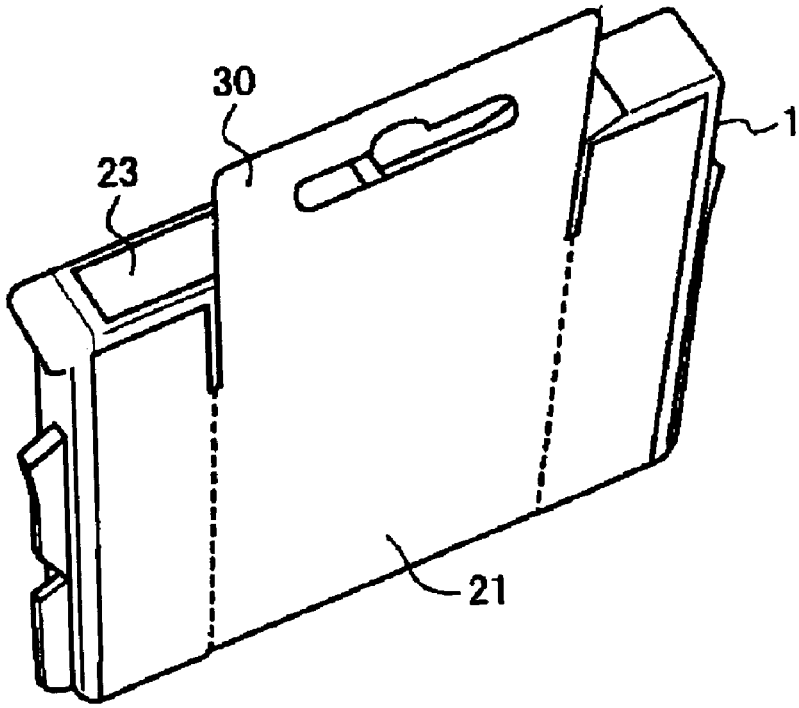
FIGS. 7A and 7B are perspective views of a state in which the packing member of the present embodiment has been adhered to an ink cartridge.
Figure 7B:
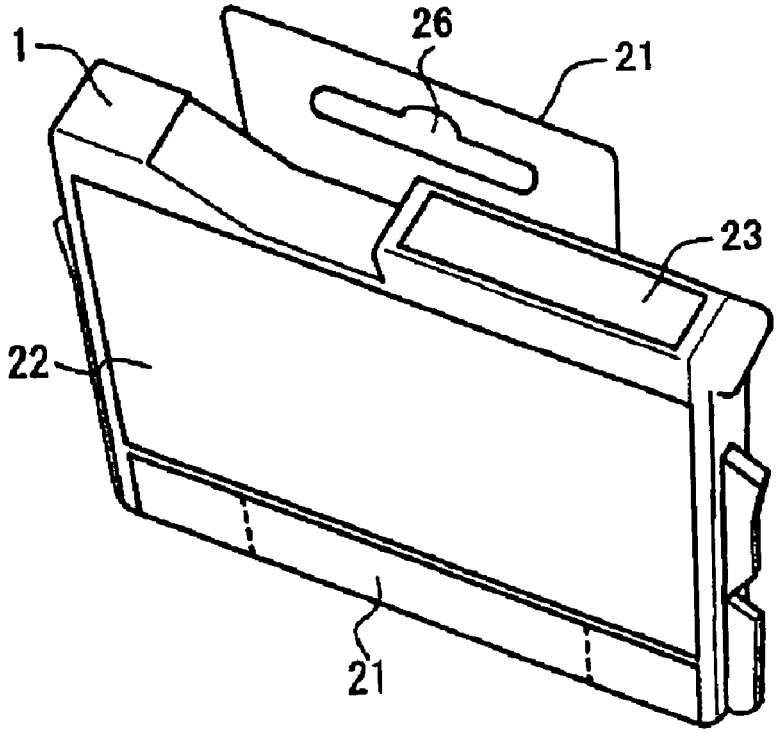

A packing work for the ink cartridge 1 using the cartridge packing member 20 of the embodiment constituted as above, namely, the labels 21 to 23 will be explained mainly with reference to FIGS. 7A and 7B and properly with reference to FIG. 4 to FIG. 6. FIGS. 7A and 7B depict a state in which each label is adhered on the ink cartridge 1, and the cartridge is shown in a state with its rear face directed downwardly. FIG. 7A depicts the cartridge when viewed from the right side face thereof and FIG. 7B depicts the cartridge when viewed from the left side face thereof.

Procedures for packing are itemized below. In each procedure, the figure number, which should be mainly referred to, is shown in a parenthesis.

1: First, peeling off the release coated paper of the front face label 23 to adhere the front face label 23 on a portion of the front face of the cartridge 1 between the projection portion 2 and the corner portion 4 (FIGS. 7A and 7B).

2: Next, peeling off the release coated paper of the side face label 22 to adhere the side face label 22 on a portion of the cartridge 1 on the right side face (FIGS. 7A and 7B).

3: Peeling off the upper release coated paper 27(1) of the main label 21 to fold the main label 21 along the cutting line 28 of the release coated paper 27(2) to be left unpeeled thereby performing adhesion using the release coated paper 27(2) as a core (FIG. 5 and FIG. 6). Thus, two surface sheets and the release coated paper therebetween are adhered so that a reinforced hanging portion 30 is formed, and simultaneously two notches 26, 26 are superimposed on each other so that one hole 26 for a rail is formed (FIGS. 7A and 7B).

4: Peeling off the release coated paper 27(3) of the main label 21. At that time, even if peeling-off starts from the right side or the left side, the release coated paper 27(3) can be peeled off up to the opposite side all around.

5: Putting, on a front side of the right side face of the ink cartridge 1, both shoulder portions (the upsides of both the left and right side portions 21*a* and *b* in FIG. 5) of the main label 21 from which the release coated paper 27(3) has been peeled off to adhere the main label 21 on the left side face of the cartridge 1 in such a manner that the label is being rubbed from its back side (FIGS. 7A and 7B). Since a proximal end portion of the hanging portion 30 is easily peeled off, adhesion thereof is securely performed. For this reason, the cutting line 29 is provided such that the portion has a wider exposure of the adhesive (the portions of the width $h_1$ in FIG. 5 and FIG. 6=both the left and right sides).

6: Folding the main label 21 from the left side face of the cartridge 1 toward the rear face to further advance adhering (FIGS. 7A and 7B).

7: Further folding the main label 21 from the rear face of the cartridge 1 toward the right side face to adhere a lower portion of the label 21 on the right side face of the cartridge (FIGS. 7A and 7B). At that time, the lower side (the lower side in FIG. 6) of the label 21 is positioned at a depth side (the lower side in FIGS. 7A and 7B) of the side face label 22.

When the adhering work of each label is completed in this manner, packing of the ink cartridge 1 using the cartridge packing member 20 of the embodiment is completed. FIGS. 7A and 7B depict a state in which packing is completed, which is also a state of the cartridge for sale. In a shop, a supplier, or the like, a rail of a display shelf is inserted into the rail hole 26 of the hanging portion 30 so that the ink cartridge 1 can be sold or stored in a hanging state thereof. The cartridges 1 may be placed on a shelf board side by side.

In the packing member 20 of the embodiment, packing can be completed by only peeling off the release coated paper of the label constituted of three parts to adhere the label on a cartridge, which is easy as a packing work. In addition, simultaneously, the hanging portion 30 for sale can be formed. Further, the entire ink cartridge is not wrapped with a packing material several times, but a portion of the cartridge is exposed, and the ink cartridge is bagged and received in a paper box. Therefore, the packing material can be reduced thus the cost is low. The amount of the release coated paper to be peeled off at a packing time is reduced and the amount of waste is also reduced.

In the packing member 20 of the embodiment, since the main label 21 is adhered from the left side face of the cartridge 1 to the rear face further over the right side face, the ink supplying tube 7 positioned at the cartridge rear face is sealed by the main label 21.

As described above, the ink cartridge 1 has the exterior case constituted by joining the left and right side face cases 1*a* and 1*b* and further fitting the rear portion cover 1*c* into the side face cases 1*a* and 1*b*, while the joining of the side face cases 1*a* and 1*b* are strengthened by adhering the front face label 23 on the case joining portion of the cartridge front face and adhering the main label 21 on the case joining portion of the cartridge rear face. Further, fitting of the rear portion cover 1*c* into the side face cases 1*a* and 1*b* is strengthened by adhering a portion of the side face label 22 and the main label 21 on the rear portion cover 1*c*.

An unpacking work of the cartridge packing member 20 of the embodiment will be explained next with reference to FIG. 8.

Procedures for unpacking will be itemized below.

1: Picking the hanging portion 30 of the main label 21 to bend the same and peeling off the proximal end portion (portion positioned inside the both side cuttings 25, 25) of the hanging portion from the cartridge.

2: Further bending the hanging portion 30 on the rear face side to release the central portion 21*c* of the main label from the both left and right side portions 21*a* and *b* along the perforations 24, 24.

3: Turning the central portion 21*c* of the main label from the rear face portion up to the right side face portion on the back side of the cartridge and releasing the central portion 21*c* from the both left and right side portions 21*a* and *b* completely, thereby completing the unpacking.

Figure 8:
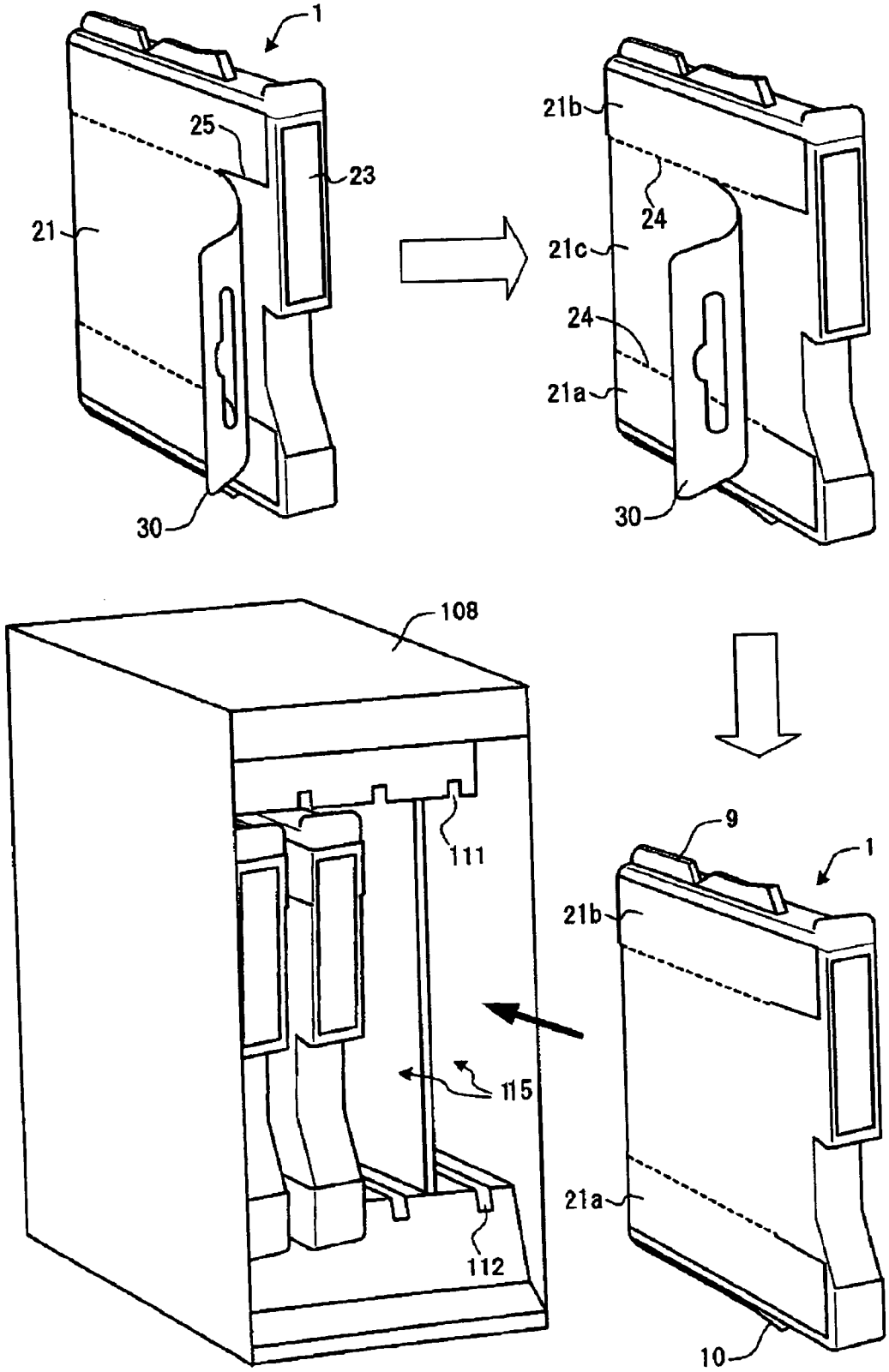
FIG. 8 is perspective views of an unpacking work of the packing member of the present embodiment.

The ink cartridge 1 of which unpacking is completed is inserted into a slot 115 of a cartridge mounting portion 108 of the printer main unit shown in FIG. 8, in such a direction as shown in FIG. 8. At that time, guide members 9 and 10 positioned on upper and lower faces of the cartridge 1 are fitted into slits 111 and 112 so that the cartridge is positioned.

The unpacking work in the cartridge packing member 20 of the embodiment is completed by turning the central portion 21*c* of the main label half round, as described above which is very easy. In addition, since the ink supplying tube 7 on the cartridge rear face is exposed by peeling off the central portion 21*c* of the main label, time and labor for peeling off a sealing member or the like separately can be saved. Further, the disposed rubbish after unpacking is only the central portion 21*c* of the main label, which results in reduction of waste.

When the cartridge is sold or stored in such a state as shown in FIGS. 7A and 7B, the proximal portion (the inside portion between the cuttings 25, 25 on both the left and right sides) of the hanging portion 30 can be easily peeled off from the cartridge 1. For example, when a customer tries to hold the cartridge 1 hung from a rail to take a look, the cartridge portion is pulled toward the customer side so that the hanging portion 30 receives resistance from the rail. Therefore, a force acts such that the proximal portion of the hanging portion 30 separates from the cartridge. In the packing member 20 of the present embodiment, however, as shown in FIG. 6, since the cutting line 29 of the release coated paper is provided such that adhesive is exposed widely (h1) on the back face of the proximal portion of the hanging portion 30, the portion can be securely adhered on the cartridge 1, and peeling-off of the proximal portion of the hanging portion can be suppressed.

In the present embodiment, since the cuttings 25, 25 are provided by the predetermined distance in an unpacking direction (in a direction of cutting off the central portion 21*c* of the main label from the both left and right side portions 21*a*, 21*b*), the label is prevented from being damaged when the proximal portion of the hanging portion 30 is peeled off.

That is, assuming that the portions of the cuttings 25, 25 are constituted of perforations 24, when the portions receive a force acting such that the proximal portion of the hanging portion 30 is peeled off from the cartridge during displaying at a shop as explained above, there is a high possibility that the label may be torn along the perforations or in a direction different from the perforations. A cartridge with a torn label is defective for sale. However, since the cuttings 25, 25 are provided, the force acting on the hanging portion 30 only serves to peel off the proximal portion of the hanging portion from the cartridge and does not damage the label. If a large force acts on the hanging portion, distal portions of the cuttings 25, 25 may tear. However, when it is a small force, the proximal portion is only peeled off, and the portion can be adhered to the cartridge again.

In the packing member 20 of the present embodiment, as shown in FIG. 6, the exposure width of adhesive inside the perforation is small as h2 (see FIG. 5) and the width of the release coated paper 27(2) becomes wider on a portion below the cuttings 25, 25 (a portion near the rear face of the cartridge). Therefore, peeling-off is suppressed by the adhesive with the width h1 in an initial stage of unpacking, but the central portion 21*c* of the main label can easily be peeled off after the portion has been peeled off. Accordingly, the unpacking work is facilitated. Since side faces of the release coated paper 27(2) left unpeeled extend along (in parallel with) the perforations 24, 24 at portions below the cuttings 25, 25, when the central portion 21*c* is cut from the both left and right side portions 21*a* and *b*, cutting at the perforations is assisted by the release coated paper 27(2), which facilitates cutting.

Since the exposure area of adhesive on a portion to be peeled off at an unpacking time (central portion 21*c*) is reduced (an area pasted on the cartridge 1 is reduced), adhesive left on the cartridge 1 after being unpacked is reduced, so that stickiness or dirt due to dusts is prevented from occurring.

In the packing member 20 of the present embodiment, since both the left and right side portions 21*a* and *b* of the main label 21 is left adhered to the cartridge after being unpacked, joining and fitting of the left and right side face cases 1*a* and 1*b* and the rear portion cover 1*c* of the cartridge 1 can be kept in a reinforced state.

The packing member 20 of the present embodiment is constituted of three labels, but the respective labels may be arranged on one adhesive sheet. It is also possible to form the respective labels by punching in one step. It is further possible to form cutting lines for respective label release coated paper by die cutting in one step.

Although the material for the label has been described above, when a label including a metal thin film layer is used, shading property can be improved, so that temperature rising inside the ink cartridge can be reduced.

A second embodiment of the packing member will be explained next.

Figure 9:
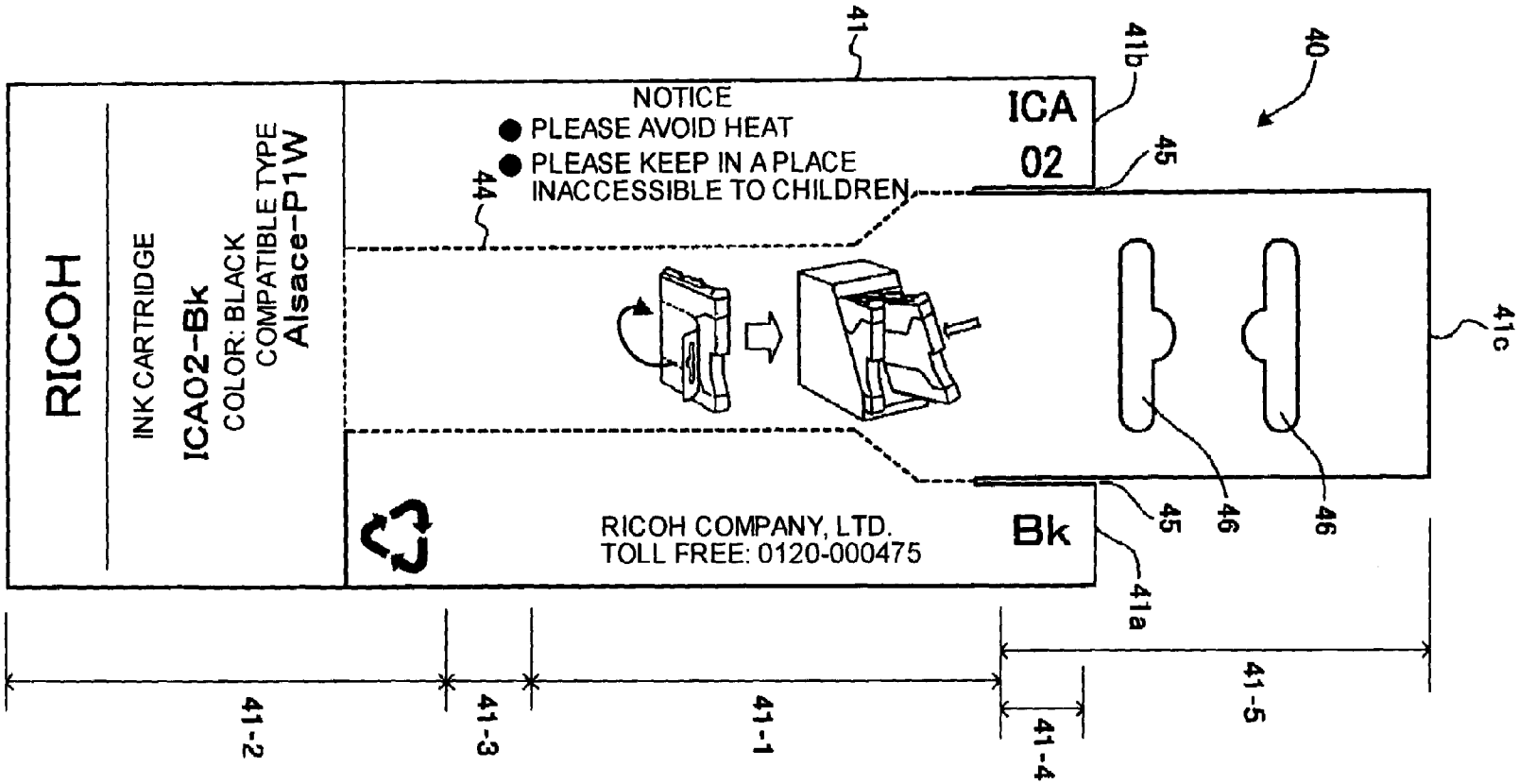
FIG. 9 is a plan view of a second embodiment of the packing member according to the present invention.

A packing member 40 of the embodiment shown in FIG. 9 is constituted of only one sheet of label 41. The label 41 has one perforation 44 formed in a substantially "Y" shape. Therefore, when a central portion 41*c* of the label 41 is cut off along the perforation 44, the label 41 is separated into two parts. In the drawing, the central portion 41*c* is provided at its upper portion with two notches 46, 46. The notches 46, 46 constitute a hole through which a hanging rail is inserted at a shop by superimposing them at a packing time as in the previous embodiment.

In FIG. 9, cuttings 45, 45 are provided at upper portions of both ends of the perforation 44, namely, in predetermined ranges extending from corners defined by the central portion 41*c* and both the left and right side portions 41*a* and *b* toward the perforation 44. The cuttings 45, 45 are for assisting unpacking such that the central portion 41*c* can be separated smoothly along the perforation 44. Function of the cuttings 45, 45 is similar to the function of the cuttings 25, 25 in the previous embodiment.

A portion of the label 41 below a portion of the perforation 44 extending horizontally in the drawing corresponds to the side face label 22 described in the previous embodiment. In this embodiment, a portion 41-2 of the label 41 shown on the right side in the drawing is a portion to be adhered to a left side face of the cartridge 1. A portion 41-3 of the label 41 shown on the right side in FIG. 9 is a portion to be adhered to a back face of the cartridge 1. A portion 41-1 of the label 41 shown on the right side in the drawing is a portion to be adhered to a right side face of the cartridge 1. Portions 41-4 of both the left and right side portions 41*a* and *b* of the label shown on the right side in the drawing are portions to be adhered to a front face of the cartridge 1. A portion 41-5 of the label central portion 41*c* shown on the right side in the drawing is a portion folded into two to constitute the hanging portion 30 (FIG. 10).

Figure 11:
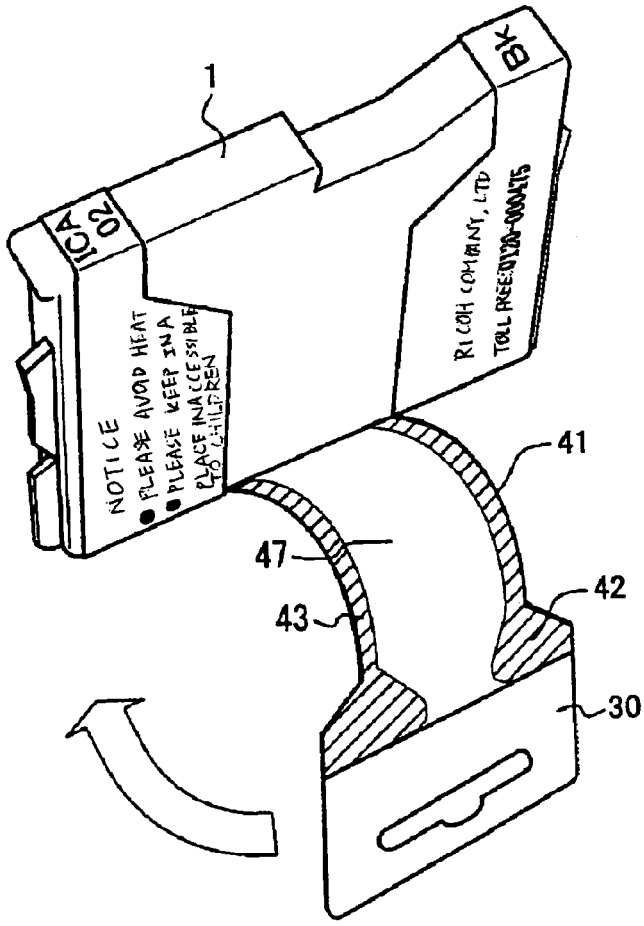
FIG. 11 is a perspective view of an unpacking work for the packing member.

A cutting line provided on a back side of the label 41, namely release coated paper is not shown, but it is provided so as to expose adhesive widely at a proximal portion of the hanging portion 30 and expose adhesive with a narrow width at a portion along the perforation 44 subsequent thereto as in the previous embodiment. FIG. 11 depicts a wide exposure portion 42 of adhesive, a narrow exposure portion 43 thereof, and release coated paper 47 left unpeeled in the label 41.

Figure 10:
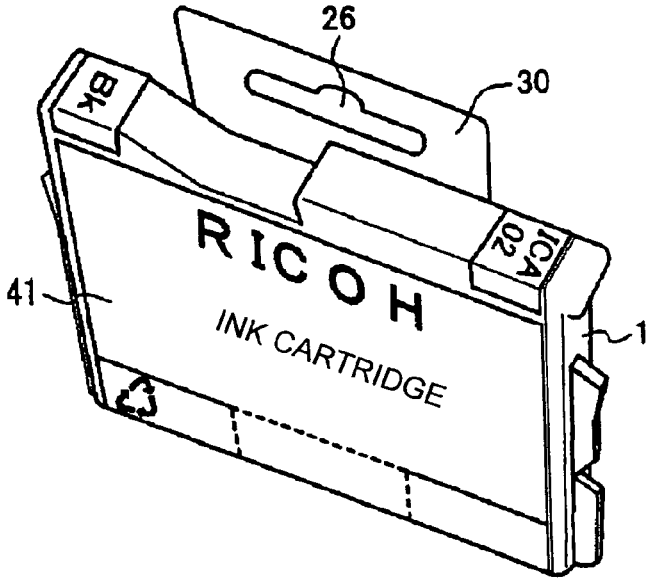
FIG. 10 is a perspective view of a state in which the packing member has been adhered to an ink cartridge.

FIG. 10 is a perspective view of a state in which the ink cartridge 1 is packed with the packing member 40 of the present embodiment.

As shown in the drawing, the label 41 is adhered from the left side face of the cartridge 1 to the right side face through the back face in an advancing manner, so that the ink cartridge 1 is packed with a sheet of label 41. In the present embodiment, since the packing member is constituted of a sheet of label 41, a packing work is facilitated incredibly.

FIG. 11 is a perspective view of an unpacking work in the packing member 40 of the present embodiment.

As shown in the drawing, by cutting the central portion of the label 41 from the both left and right side portions along the perforation, the ink cartridge 1 is unpacked. As in the previous embodiment, since unpacking is completed by only bending the hanging portion 30 to turn it about half round, the unpacking work is very easy. The ink supplying tube 7 on the rear face of the cartridge is exposed by unpacking as in the previous embodiment.

As shown in FIG. 11, since the wide exposure portion 42 is formed on the proximal portion of the hanging portion 30, peeling-off of the label can be suppressed effectively during displaying, storing, or the like. Further, for example, even if the hanging portion 30 slightly peels off, since the cuttings 45, 45 (FIG. 9) are provided, the label does not tear easily. A portion below the wide exposure portion 42 (on the back face side of the cartridge) facilitates the unpacking work owing to the narrow exposure portion 43 of adhesive. By leaving one portion of the release coated paper unpeeled, adhesion of adhesive to the cartridge after unpacking can be suppressed. Since a side of the release coated paper 47 left unpeeled in the narrow exposure portion 43 extends along the perforation 44 (in parallel), unpacking is easy.

As shown in FIG. 10 and FIG. 11, since end portions of the both left and right side portions 41*a* and *b* of the label 41 (portions with indication of "ICA02" representing a cartridge model number and "Bk" representing an ink color), that is, portions shown by 41-4 on the right side in FIG. 9 are adhered on the front face of the cartridge 1, the portion of the label 41 shown by 41-3 on the right side in FIG. 9 is adhered to the rear face of the cartridge 1, and these portions remain adhered after cartridge is unpacked (one portion of the portion indicated by 41-3 is left), joining and fitting of the left and right side face cases 1*a* and 1*b* and the rear portion cover 1*c* (FIGS. 1A to 1D and FIG. 2) of the cartridge 1 can be kept in a reinforced state.

In the present embodiment, since the packing member 40 is constituted of one sheet of label 41, a packing work is simplified. Efficiency of manufacturing or storage of the packing member is improved. In the present embodiment also, it is possible to form the label 41 by punching in one step, and form the release coated paper cutting line of the label 41 by die cutting in one step.

In the present embodiment, since the portion 41*c* to be cut off at an unpacking time is formed in a substantially Y shape, unpacking is facilitated by reducing a cut-off area, and since the area of the label left after unpacking increases, an amount of information which can be indicated on the label (by printing or the like) can be increased.

As shown in FIG. 9, in the packing member 40 of the present embodiment, an indication of procedure for an unpacking work is provided on the portion (41*c*) to be cut off at an unpacking time. Indications of the model number of the cartridge or ink color, or reminder for cartridge handling or contact address are provided on a portion left adhered to the cartridge after unpacking. Similar indications can be provided also in the previous embodiment.

All indications are provided on a surface of the packing member before unpacking of the cartridge, and the procedure for an unpacking work of the cartridge becomes unnecessary after unpacking, but the model number of the cartridge or the ink color, or the reminder for cartridge handling are necessary even after unpacking or at an exchanging time after ink consumption. In the packing member of the present invention, since the indications that become unnecessary after unpacking are provided on the cutting-off portion and the indications required after unpacking are provided on the portions left adhered after unpacking, the indications required by a user can be seen as necessary.

In the conventional packing aspect where an ink cartridge is bagged or packed in a box, various indications provided on a surface of a bag or a box are discarded after unpacking, so that information required after unpacking can not be provided to a user. However, in the packing member and an ink cartridge packed body of the present invention, both of the information required before unpacking (the procedure of unpacking work, disposal procedure of rubbish caused by unpacking, and the like) and the information required after unpacking (the model number or the ink color, the reminder for handling, and the like) can be precisely provided to the user through the indications provided on the packing member. For achieving these functions in the conventional packing aspect, indications must be provided on both the packing member and the ink cartridge (a cartridge in the packing member) itself, which results in increase in cost. The packing member and the ink cartridge packed by the packing member of the present embodiment do not require double indications.

While the present invention is explained above with reference to the drawings, it is not limited thereto. For example, the appearance, the size, or the like of the label constituting the packing member can be set arbitrarily. The size or shape of the wide exposure portion of adhesive, the width of the narrow exposure portion, or the lengths of the cuttings 25 and 45 can be set arbitrarily. The width, the length, the shape, and the like of the portions of the label to be cut off are not limited to the shown ones, but they may be set arbitrarily. The shape or the size of the hanging portion 30, the rail hole and the like can be set arbitrarily. Further, the constitution of the ink cartridge can be adopted arbitrarily. The shape of the packing member, the size, and the shape of the cutting-off portion, or the like can be set so as to correspond to the shape, the size, and the like of the ink cartridge. Directions and the like for packing and unpacking can be set arbitrarily.

As explained above, according to the packing member of the ink cartridge of the invention, since the packing member is constituted as the adhesive label, the cutting-off assisting work is provided on one portion of the label, the ink cartridge is packed by adhering the label to the cartridge, and the ink cartridge is unpacked by peeling off the one portion of the label along the cutting-off assisting work, the amount of the packing member can be reduced and the amount of rubbish to be disposed due to unpacking can be reduced. Further, packing and unpacking can be performed easily.

Since one portion of the release coated paper of the adhesive label is left unpeeled to be adhered on the cartridge, peeling-off of the label at an unpacking time is easy.

Since the release coated paper left unpeeled is formed on a portion of the label to be cut off at an unpacking time, a portion of the label unpacked by being cutting off can be peeled off from the cartridge easily, and adhesive can be prevented from remaining on the cartridge surface after unpacking.

Since the tearing-off line for the release coated paper is provided such that an end side of at least one portion of the release coated paper left unpeeled extends along the cutting-off assisting work, cutting-off of the label can be performed using the end side of the release coated paper as a core, cutting-off is prevented from deviating from the cutting-off assisting work, which facilitates the unpacking work.

Since a portion of the label to be cut off at an unpacking time has the adhesive exposure portion on the label back face in a predetermined range within the cutting-off assisting work, floating of the cutting-off portion can be suppressed to the utmost even if the release coated paper is left.

Since the hanging portion formed with the hanging rail insertion hole is provided, displaying, storing, or the like can be performed easily.

Since the release coated paper of the adhesive label is partially left on the hanging portion, the strength of the hanging portion can be increased.

Since the hanging portion is formed by adhering two label surface sheets to each other so as to sandwich the release coated paper left partially, the strength of the hanging portion can be further enhanced.

Since the tearing-off line of the release coated paper left partially serves as an assistant line when two label surface sheets are adhered to each other, an adhering work can be facilitated, and the label surface sheets do not adhere to each other with a state deviated from each other.

Since the shapes of the two label surface sheets and the left release coated paper in the hanging portion are the same, the strength of the entire hanging portion can be further enhanced.

Since the hanging portion is the unpacking starting portion at a time of cartridge unpacking, an unpacking work can be conducted easily by utilizing the hanging portion as a guide at a time of peeling off the label.

Since the wide exposure portion of adhesive is formed on the proximal portion of the hanging portion, the proximal portion of the hanging portion that is easily peeled off can be firmly adhered.

Since the cutting-off assisting work starts from extension lines on both side edges of the hanging portion, the unpacking work can be conducted smoothly while holding the hanging portion.

Since cuttings are provided in predetermined ranges on both sides of the proximal portion of the hanging portion, the label can be prevented from being damaged at the proximal portion of the hanging portion and even if the label is peeled off at the proximal portion, the peeled-off label can be recovered to its original state by re-adhering.

Since the ends of the cuttings and the end of the cutting-off assisting work are in communication with each other, cutting is naturally guided by the assisting work in unpacking work conducted while the hanging portion is held, so that the unpacking work is facilitated and the label is prevented from being damaged.

Since the tearing-off line for the release coated paper is provided such that the release coated paper can be continuously peeled off to cross the cutting-off assisting work, the release coated paper of the cutting-off portion and the remaining portion can be continuously peeled off using the cutting-off assisting work as a boundary, which facilitates the packing work.

Since the ink supplying portion of the ink cartridge is sealed with a portion of the label cut off at an unpacking time, it is unnecessary to provide a sealing member separately.

Since the remaining portion cut off at an unpacking time is adhered to the joining portion of a member constituting the exterior case of the ink cartridge even after unpacking, the strength of the cartridge can be maintained even after unpacking.

Since the remaining portion cut off at an unpacking time is adhered to the fitting portion of a part constituted as a separate part to the-case main unit near the ink supplying portion of the ink cartridge even after unpacking, the fitting of the separate part into the case main unit can be reinforced even after unpacking.

Since the packing member is constituted as one sheet of adhesive label, cost for the packing member can be suppressed.

Since the packing member is formed by punching in one step, cost for the packing member can be suppressed.

Since the tearing-off line for the release coated paper of the packing member is formed by die cutting in one step, cost for the packing member can be suppressed.

Since a portion to be cut off at an unpacking time is formed in a substantially Y shape, unpacking is facilitated by reducing a cut-off area, and since the area of the label left after unpacking increases, an amount of information that can be indicated on the label can be increased.

Since the information required before cartridge unpacking is indicated on the portion to be cut off at an unpacking time, an indication required by the user can be seen when it is necessary. Indications after unpacking can be seen more clearly.

Since information required after cartridge unpacking is indicated on the remaining portion to be cut off at the unpacking time, an indication required by the user can be seen when it is necessary.

According to the ink cartridge packed body of the present invention and the packing/unpacking method of an ink cartridge of the present invention, the amount of the packing member can be reduced and the amount of rubbish to be disposed after unpacking can be reduced. Packing and unpacking works are conducted easily.

INDUSTRIAL APPLICABILITY

As described above, the packing member for an ink cartridge, the packed body of an ink cartridge, and the packing/unpacking method of an ink cartridge according to the present invention are useful for a technique relating to packing for a printer supply such as an ink cartridge or an ink ribbon, and especially suitable for an inkjet printer using an ink cartridge or a system thereof.

The invention claimed is:

1. A packing member for packing an ink cartridge, comprising:

a label sheet, the label sheet including:

a coat of adhesive on a first surface;

a first portion;

a second portion; and a weakened or cut label sheet portion between the first portion and the second portion, wherein a part of the second portion is surrounded by the weakened or cut label sheet portion, the first portion and the second portion are configured to be readily torn apart at the weakened or cut label sheet portion, and the second portion includes a hanging portion that includes a hole configured to be hung from a rail; and a release coated paper adhered to the first surface of the label sheet, the release coated paper including:

a first zone;

a second zone; and a weakened or cut release coated paper portion separating the first zone and the second zone, wherein a part of the second zone is surrounded by the weakened or cut label sheet portion, and the first zone and the second zone are configured to be readily torn apart at the weakened or cut release paper portion, wherein when the packing member is adhered to the ink cartridge:

the first zone is configured to be torn apart from the second zone of the release coated paper and apart from the first surface such that the second zone remains adhered to the first surface, and the packaging member is configured to adhere to the ink cartridge in a manner such that an area of the label sheet, where the first zone is configured to be torn apart from the first surface, is configured to adhere to a portion of the ink cartridge from a first side face of the cartridge up to a second side face of the cartridge via a rear face portion of the cartridge in a turning manner so that a part of the second portion contacts an ink supplying portion of the ink cartridge to seal the ink supplying portion.

2. The packing member according to claim 1, wherein the first zone of the release coated paper that is adhered to the first surface the label sheet extends over at least part of the second portion and at least part of the first portion.

3. The packing member according to claim 1, wherein the release coated paper includes a plurality of portions that are separated by a plurality of weakened or cut release paper portions that overlap with the weakened or cut label sheet portion.

4. The packing member according to claim 1, wherein a portion of the coat of adhesive on the first surface of the label sheet is partially exposed on a surface of the first portion.

5. The packing member according to claim 1, wherein the release coated paper includes a third zone located within a perimeter of the hanging portion, the third zone of the release coated paper configured to be separated from the first surface of the label sheet without separating the second zone of the release coated paper from the first surface of the label sheet so that a portion of the second zone of the release coated paper remains adhered to the hanging portion.

6. The packing member according to claim 5, wherein the hanging portion is formed by sandwiching the portion of the second zone of the release coated paper that remains adhered to the hanging portion between two sheets.

7. The packing member according to claim 6, wherein an end side of the portion of the second zone of the release coated paper that remains adhered to the hanging portion is configured to serve as an assisting line when the hanging portion is formed.

8. The packing member according to claim 6, wherein the release coated paper that remains adhered to the hanging portion has an identical shape as the two sheets.

9. The packing member according to claim 1, wherein the ink cartridge packed with the packing member is configured to be unpacked from the hanging portion.

10. The packing member according to claim 1, wherein the first zone of the release coated paper narrows from a first width just below the hanging portion to a second width narrower than the first width and further from the hanging portion, so that removing the first zone of the release coated paper exposes a wider portion of adhesive at the first width than the second width.

11. The packing member according to claim 1, wherein a second weakened or cut label sheet portion and an end side of the hanging portion are on an identical line.

12. The packing member according to claim 1, further comprising:

a plurality of weakened or cut label sheet portions that are arranged on extension lines of both end sides of the hanging portion.

13. The packing member according to claim 12, wherein the plurality of weakened or cut label sheet portions are linked.

14. The packing member according to claim 1, wherein the packing member is configured to pack the ink cartridge by separating the first zone of the release coated paper from the first surface of the label sheet, peeling the first zone of the release coated paper across the weakened or cut label sheet portion so that a portion of the coat of adhesive on the first surface of the label sheet is partially exposed, and adhering the packing member to the ink cartridge.

15. The packing member according to claim 1, wherein the second portion is configured to seal an ink supplying portion of the ink cartridge.

16. The packing member according to claim 1, wherein the first portion is configured to adhere on a joint of an exterior case of the ink cartridge after unpacking the ink cartridge.

17. The packing member according to claim 1, wherein the first portion is configured to be adhered on a separate part that is set in the ink cartridge to cover an ink supplying portion after unpacking the ink cartridge.

18. The packing member according to claim 1, wherein the packing member includes a sheet of adhesive label.

19. The packing member according to claim 1, wherein the packing member is formed by punching in one step.

20. The packing member according to claim 1, wherein the release coated paper includes a plurality of portions that are separated by a plurality of weakened or cut release coated paper portions, and wherein the plurality of weakened or cut release coated paper portion are formed by die cutting in one step.

21. The packing member according to claim 1, wherein the first portion is formed in a substantially Y shape.

22. The packing member according to claim 1, wherein information required before unpacking the ink cartridge is indicated on the second portion.

23. The packing member according to claim 1, wherein information required after unpacking the ink cartridge is indicated on the first portion.

24. A combination of an ink cartridge and a packing member for packing the ink cartridge, wherein the packing member includes a label sheet, the label sheet including:

a coat of adhesive on a first surface;

a first portion;

a second portion; and a weakened or cut label sheet portion between the first portion and the second portion;

wherein a part of the second portion is surrounded by the weakened or cut label sheet portion, the first portion and the second portion are configured to be readily torn apart at the weakened or cut label sheet portion, and the second portion includes a hanging portion that includes a hole configured to be hung from a rail; and a release coated paper adhered to the first surface of the label sheet, the release coated paper including:

a first zone;

a second zone; and a weakened or cut release coated paper portion separating the first zone and the second zone, wherein a part of the second zone is surrounded by the weakened or cut label sheet portion, and the first zone and the second zone are configured to be readily torn apart at the weakened or cut release paper portion, wherein when the packing member is adhered to the ink cartridge:

the first zone is configured to be torn apart from the second zone of the release coated paper and apart from the first surface such that the second zone remains adhered to the first surface, and the packaging member is configured to adhere to the ink cartridge in a manner such that an area of the label sheet, where the first zone is configured to be torn apart from the first surface, is configured to adhere to a portion of the ink cartridge from a first side face of the cartridge up to a second side face of the cartridge via a rear face portion of the cartridge in a turning manner so that a part of the second portion contacts an ink supplying portion of the ink cartridge to seal the ink supplying portion.

25. A method for packing an ink cartridge with a packing member, the method comprising:

cutting a label sheet so as to create a weakened or cut label sheet portion between a first portion and a second portion of the label sheet;

applying a coat of adhesive on a first surface of the label sheet;

cutting a release coated paper to create a weakened or cut release coated paper portion separating a first zone and a second zone of the release coated paper;

adhering the release coated paper to the first surface of the label sheet;

removing the first zone of release coated paper from the first surface of the label sheet so as to partially expose the coat of adhesive; and adhering the packing member to the ink cartridge, wherein the cutting the release coated paper and the adhering the release coated paper are performed so that a perimeter of the second zone of the release coated paper is entirely within a perimeter of the second portion of the label sheet.

26. The method according to claim 25, wherein the cutting the release coated paper and the adhering the release coated paper are performed so that the first zone of the release coated paper that is adhered to the first surface the label sheet extends over at least part of the second portion and at least part of the first portion.

27. The method according to claim 25, wherein unpacking the ink cartridge that is packed with the packing member comprises:

tearing off a portion of the packing member by pulling the portion in a specific direction.

* * * * *